US009121126B2

(12) United States Patent
Lee et al.

(10) Patent No.: US 9,121,126 B2
(45) Date of Patent: Sep. 1, 2015

(54) WASHING MACHINE AND CONTROL METHOD THEREOF

(75) Inventors: Moo Hyung Lee, Seoul (KR); Sung Jin Kim, Seongnam-si (KR); Myung Sun Kang, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1164 days.

(21) Appl. No.: 13/064,903

(22) Filed: Apr. 25, 2011

(65) Prior Publication Data

US 2012/0084926 A1 Apr. 12, 2012

(30) Foreign Application Priority Data

Oct. 6, 2010 (KR) ..... 10-2010-0097387

(51) Int. Cl.
*D06F 37/22* (2006.01)
*D06F 33/02* (2006.01)

(52) U.S. Cl.
CPC ..... *D06F 37/225* (2013.01); *D06F 33/02* (2013.01); *D06F 2222/00* (2013.01)

(58) Field of Classification Search
CPC .... D06F 37/225; D06F 33/02; D06F 2222/00
USPC ..... 68/12.06, 23.2, 24
See application file for complete search history.

(56) References Cited

U.S. PATENT DOCUMENTS

| | | | | |
|---|---|---|---|---|
| 4,653,169 | A * | 3/1987 | Puszakowski | 29/445 |
| 5,813,253 | A * | 9/1998 | Uhlin | 68/23.2 |
| 5,862,553 | A * | 1/1999 | Haberl et al. | 8/159 |
| 6,327,732 | B1 * | 12/2001 | Braunschweig et al. | 8/159 |
| 2003/0110814 | A1 * | 6/2003 | Southworth et al. | 68/23.2 |
| 2012/0192362 | A1 * | 8/2012 | Lee et al. | 8/137 |

FOREIGN PATENT DOCUMENTS

| | | | |
|---|---|---|---|
| CN | 101643992 | | 2/2010 |
| EP | 2514864 | A4 * | 10/2012 |
| JP | 03261500 | A * | 11/1991 |
| JP | 08-229287 | | 9/1996 |
| KR | 10-2008-0037428 | | 4/2008 |

OTHER PUBLICATIONS

Chinese Office Action issued Nov. 25, 2014 in corresponding Chinese Patent Application No. 201110146732.8.

* cited by examiner

*Primary Examiner* — Joseph L Perrin
(74) *Attorney, Agent, or Firm* — Staas & Halsey LLP

(57) ABSTRACT

A washing machine in which performance of a balancer is improved and a control method thereof. The washing machine includes at least one balancer housing provided with a ring-shaped channel, at least one mass body movably disposed in the channel, a confinement unit to confine the at least one mass body to the at least one balancer housing so as to allow the at least one mass body to be rotated under the condition that the at least one mass body is fixed to the at least one balancer housing, an adjustment unit to release confinement of the at least one mass body so as to allow the at least one mass body to descend due to gravity during rotation of the drum, and a control unit to control the adjustment unit so that unbalanced load is offset by the at least one mass body.

12 Claims, 11 Drawing Sheets

WASHING MACHINE AND CONTROL METHOD THEREOF

CROSS-REFERENCE TO RELATED APPLICATIONS

This application claims the benefit of Korean Patent Application No. 2010-0097387, filed on Oct. 6, 2010 in the Korean Intellectual Property Office, the disclosure of which is incorporated herein by reference.

BACKGROUND

1. Field

Embodiments relate to a washing machine having a balancer to offset unbalanced load.

2. Description of the Related Art

In general, a washing machine includes a drum to receive laundry, such as clothes, and a motor to drive the drum, and performs a series of cycles, such as washing, rinsing and spin-drying cycles, using rotation of the drum.

When laundry is not uniformly distributed in the drum and accumulates at a specific portion of the inside of the drum during rotation of the drum, vibration and noise occur due to eccentric rotation of the drum, and if such eccentric rotation becomes severe, a part of the washing machine, such as the drum or the motor, may be damaged.

Therefore, the washing machine is provided with a balancer which offsets unbalanced load generated from the inside of the drum to stabilize rotation of the drum.

SUMMARY

Therefore, it is an aspect to provide a washing machine in which performance of a balancer is improved and a control method thereof.

Additional aspects will be set forth in part in the description which follows and, in part, will be apparent from the description, or may be learned by practice of the invention.

In accordance with one aspect, a washing machine includes a cabinet, a tub disposed within the cabinet to receive water therein, a drum disposed within the tub to receive laundry therein and rotated by rotational force transmitted from a drive source, at least one balancer housing mounted on the drum and provided with a ring-shaped channel formed therein, at least one mass body movably disposed in the channel of the at least one balancer housing, respectively, a confinement unit to confine the at least one mass body to the at least one balancer housing so as to allow the at least one mass body to be rotated under the condition that the at least one mass body is fixed to the at least one balancer housing, an adjustment unit to release confinement of the at least one mass body so as to allow the at least one mass body to descend due to gravity during rotation of the drum, and a control unit to control the adjustment unit so that unbalanced load present in the drum is offset by the at least one mass body.

One of the at least one mass body and the confinement unit may include a permanent magnet, and the other one of the at least one mass body and the confinement unit may include at least one magnetic body so as to attach the at least one mass body to the at least one balancer housing through magnetic force.

The adjustment unit may include at least one electromagnet disposed around the at least one balancer housing so as to generate magnetic force in a direction offsetting attractive force applied between the at least one mass body and the at least one balancer housing.

The at least one electromagnet may be disposed above a horizontal line passing through the center of rotation of the drum.

The at least one electromagnet may be disposed in a region which is in the range of angles of 30~60° with respect to the horizontal line.

The at least one electromagnet may include a plurality of electromagnets arranged in the circumferential direction of the drum, and two of the plurality of electromagnets may be disposed at opposite sides of a vertical line passing through the center of rotation of the drum.

The at least one mass body may include a first mass body and a second mass body disposed in different channels, and the at least one electromagnet may include at least one first mass body controlling electromagnet disposed to apply magnetic force to the first mass body and at least one second mass body controlling electromagnet disposed to apply magnetic force to the second mass body.

The washing machine may further include a load sensor to sense magnitude and direction of the unbalanced load applied to the drum during rotation of the drum and a position sensor to sense a rotated position of the at least one mass body, and the control unit may determine a position of the at least one mass body to offset the unbalanced load based on sensing results of the load sensor and the position sensor, and controls the at least one electromagnet so that the at least one mass body is moved to the determined position.

The at least one mass body may include a permanent magnet, and the confinement unit may include a ring-shaped plate provided on the balancer housing so as to be located at the outside of the channel in the radial direction of the drum.

The at least one balancer housing may be an injection molded product made of plastic, and the ring-shaped plate may be inserted into the at least one balancer housing.

The at least one mass body may include a permanent magnet, and the at least one balancing housing may be made of a metal attracted to the magnet and serves as the confinement unit.

The drum may include a cylindrical part, and a front plate and a rear plate respectively disposed at the front and rear portions of the cylindrical part, the at least one balancer housing may include a first balancer housing and a second balancer housing disposed so as to be stacked in the direction of a rotation axis of the drum, and the first balancer housing and the second balancer housing may be mounted on at least one of the front plate and the rear plate.

The at least one mass body may be formed in a rod shape extended in the circumferential direction of the ring-shaped channel.

The inside of the channel of the at least one balancer housing may be filled with a damping fluid.

In accordance with another aspect, a washing machine includes a cabinet, a tub disposed within the cabinet to receive water therein, a drum disposed within the tub to receive laundry therein and rotated by rotational force transmitted from a motor, a first balancer mounted on the drum, and including a first balancer housing having a ring-shaped first channel, and a first mass body movably disposed in the first channel and attached to the first balancer housing by magnetic force, a second balancer mounted on the drum, and including a second balancer housing having a ring-shaped second channel, and a second mass body movably disposed in the second channel and attached to the second balancer housing by magnetic force, at least one first mass body controlling electromagnet disposed around the first balancer housing to generate magnetic force so as to allow the first mass body to descend due to gravity during rotation of the drum, at least one second mass body controlling electromagnet disposed around the second balancer housing to generate magnetic force so as to allow the second mass body to descend due to gravity during rotation of the drum, and a control unit to control the at least one first mass body controlling electromagnet and the at least one second mass body controlling electromagnet so that the first mass body and the second mass body are moved to positions offsetting unbalanced load present in the drum.

In accordance with a further aspect, a control method of a washing machine, which has a drum, at least one balancer housing mounted on the drum and at least one mass body movably disposed in the at least one balancer housing, includes rotating the drum under the condition that movement of the at least one mass body relative to the at least one balancer housing is restricted, detecting magnitude of unbalanced load applied to the drum, and applying current to at least one electromagnet disposed around the at least one balancer housing so that the at least one mass body descends due to gravity, if the detected magnitude of the unbalanced load is greater than a reference value.

The at least one mass body may include a first mass body and a second mass body disposed so that the first mass body and the second mass body are movable along different channels, and the control method may further include sensing direction of the unbalanced load applied to the drum and detecting positions of the first mass body and the second mass body.

The at least one electromagnet may include a first mass body controlling electromagnet and a second mass body controlling electromagnet disposed at the same side of a vertical line passing through the center of rotation of the drum, and the application of current to the at least one electromagnet may include selecting at least one of the first mass body and the second mass body and applying current to the electromagnet corresponding to the at least one of the first mass body and the second mass body.

The at least one electromagnet may include a pair of first mass body controlling electromagnets disposed at different sides of a vertical line passing through the center of rotation of the drum and a pair of second mass body controlling electromagnets disposed at different sides of the vertical line, and the application of current to the at least one electromagnet may include selecting one of the pair of first mass body controlling electromagnets and one of the pair of second mass body controlling electromagnets and applying current to the selected electromagnets.

The control method may further include determining a position of the at least one mass body to offset the unbalanced load, calculating the number of times of rotation of the drum until the at least one mass body reaches the determined position, and interrupting the current applied to the at least one electromagnet when the calculated number of times of rotation of the drum has been completed.

BRIEF DESCRIPTION OF THE DRAWINGS

These and/or other aspects will become apparent and more readily appreciated from the following, description of the embodiments, taken in conjunction with the accompanying drawings of which.

DETAILED DESCRIPTION

Figure 1:
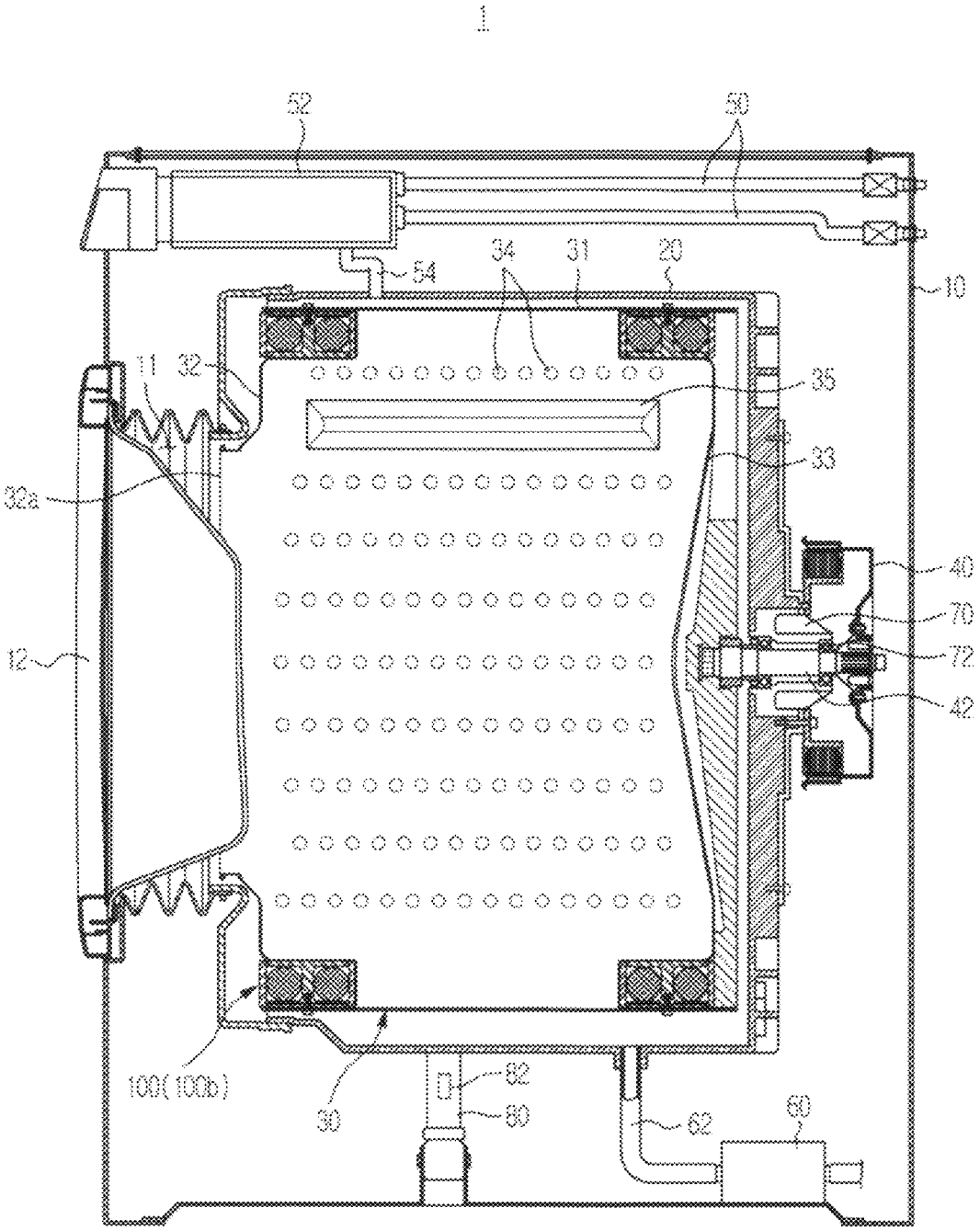
FIG. 1 is a longitudinal-sectional view illustrating a configuration of a washing machine in accordance with one embodiment.

Reference will now be made in detail to the embodiments, examples of which are illustrated in the accompanying drawings, wherein like reference numerals refer to like elements throughout.

FIG. 1 is a longitudinal-sectional view illustrating a configuration of a washing machine in accordance with one embodiment.

As shown in FIG. 1, a washing machine 1 includes a cabinet 10 forming the external appearance of the washing machine, a tub 20 disposed within the cabinet 10, a drum 30 rotatably disposed within the tub 20, and a motor 40 to drive the drum 30.

An inlet 11 is formed through the front surface part of the cabinet 10 such that laundry is input to the inside of the drum 30 through the inlet 11. The inlet 11 is opened and closed by a door 12 installed on the front surface part of the cabinet 10.

A water supply pipe 50 to supply wash water to the tub 20 is installed above the tub 20. One end of the water supply pipe 50 is connected to an external water supply source (not shown), and the other end of the water supply pipe 50 is connected to a detergent supply device 52.

The detergent supply device 52 is connected to the tub 20 through a connection pipe 54. Water supplied through the water supply pipe 50 is supplied to the inside of the tub 20 together with detergent via the detergent supply device 52.

The tub 20 is supported by a damper 80. The damper 80 connects the inner lower surface of the cabinet 10 and the outer surface of the tub 20.

A drain pump 60 and a drain pipe 62 to discharge water in the tub 20 to the outside of the cabinet 10 are installed below the tub 20.

The drum 30 includes a cylindrical part 31, a front plate 32 disposed at the front portion of the cylindrical part 31, and a rear plate 33 disposed at the rear portion of the cylindrical part 31. An opening 32*a* through which laundry is put into the drum 30 is formed through the front plate 32, and a drive shaft 42 to transmit power of the motor 40 is connected to the rear plate 33.

A plurality of through holes 34 is formed through the circumferential surface of the drum 30, and a plurality of lifters 35 to tumble laundry during rotation of the drum 30 is formed on the inner circumferential surface of the drum 30.

The drive shaft 42 is disposed between the drum 30 and the motor 40. One end of the drive shaft 42 is connected to the rear plate 33 of the drum 30, and the other end of the drive shaft 42 is extended to the outside of the rear wall of the tub 20. When the motor drives the drive shaft 42, the drum 30 connected to the drive shaft 42 is rotated about the drive shaft 42.

A bearing housing 70 to rotatably support the drive shaft 42 is installed on the rear wall of the tub 20. The bearing housing 70 is made of aluminum alloy, and is inserted into the rear wall of the tub 20 when the tub 20 is injection molded. Bearings 72 are installed between the bearing housing 70 and the drive shaft 42 so that the drive shaft 42 is smoothly rotated.

During the washing cycle, the motor 40 rotates the drum 30 at a low speed in a regular direction and the reverse direction, and thereby laundry within the drum 30 is repeatedly tumbled so as to remove contaminants from the laundry.

During the spin-drying cycle, when the motor 40 rotates the drum 30 at a high speed in one direction, water is separated from the laundry by centrifugal force applied to the laundry.

If the laundry is not uniformly distributed in the drum 30 and accumulates at a specific region of the inside of the drum 30 during rotation of the drum 30 in the spin-drying cycle, the rotation of the drum 30 becomes unstable, thus causing vibration and noise.

Therefore, the washing machine 1 is provided with a balancing device 100 to stabilize rotation of the drum 30. FIG. 1 exemplarily illustrates application of a balancing device 100*b* of FIG. 5 to the washing machine.

Figure 2:
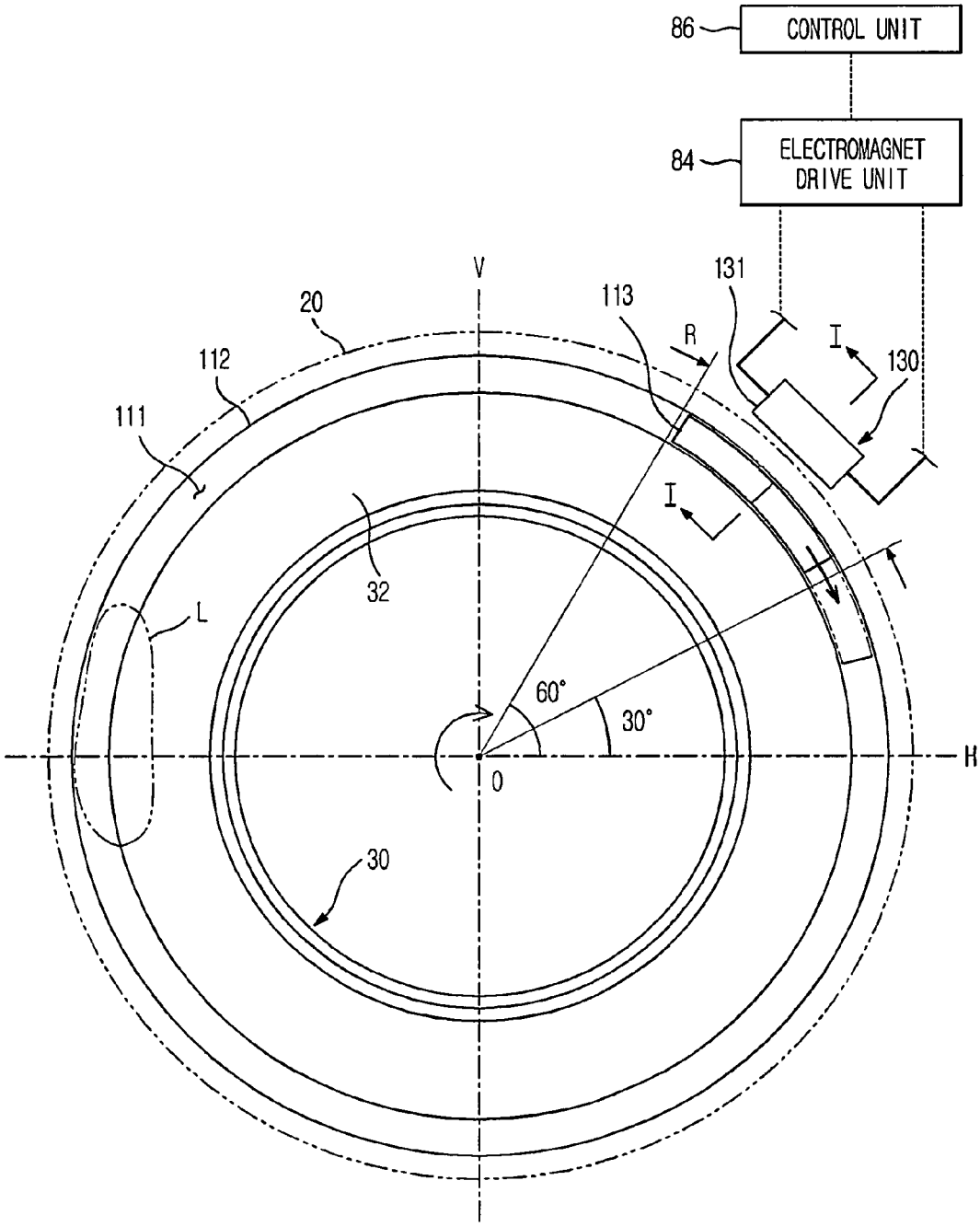
FIG. 2 is a view illustrating a configuration of a balancing device of a washing machine in accordance with one embodiment.
Figure 3:
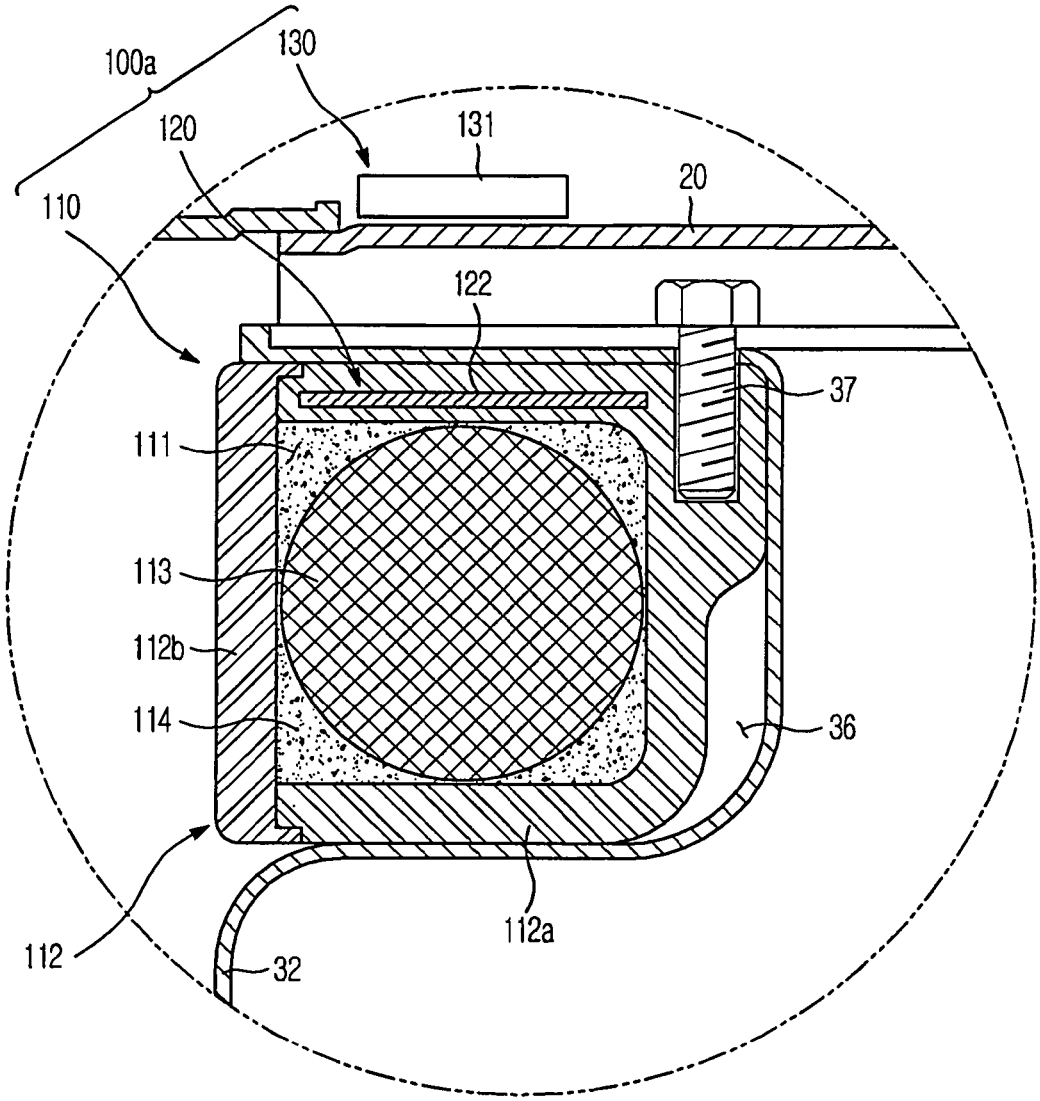
FIG. 3 is a cross-sectional view taken long the line I-I of FIG. 2.

FIG. 2 is a view illustrating a configuration of a balancing device of a washing machine in accordance with one embodiment and FIG. 3 is a cross-sectional view taken along the line I-I of FIG. 2. In FIG. 2, a confinement unit and a damping fluid are omitted.

As shown in FIGS. 2 and 3, the balancing device 100*a* includes a balancer 110, a confinement unit 120 and an adjustment unit 130.

The balancer 110 includes a balancer housing 112 having a ring-shaped channel 111. A mass body 113 is movably disposed in the channel 111 of the balancer 110. The mass body 113 moves in the channel 111 so as to offset unbalanced load present in the drum 30 during rotation of the drum 30.

The balancer 110 is mounted on the front plate 32 of the drum 30. A ring-shaped recess 36, the front portion of which is opened, is formed on the front plate 32 of the drum 30, and the balancer housing 112 is received in the recess 36. The balancer housing 112 is connected to the drum 30 through fastening members 37 so as to be firmly fixed to the drum 30. Alternatively, the balancer 110 may be mounted on the rear plate 33 of the drum 30 in the same manner.

The balancer housing 112 includes a ring-shaped housing body 112*a*, one side of which is opened, and a cover 112*b* covering the opened side of the housing body 112*a*. The ring-shaped channel 111 is defined by the inner surface of the housing body 112*a* and the inner surface of the cover 112*b*.

The inside of the channel 111 of the balancer housing 112A is filled with the damping fluid 114 to prevent the mass body 113 from rapidly moving. The damping fluid 114 applies resistance to the mass body 113 when force is applied to the mass body 113, thereby preventing the mass body 113 from rapidly moving within the channel 111.

The damping fluid 114 may be oil. The damping fluid 114 serves to balance the drum 30 together with the mass body 113 during rotation of the drum 30.

As shown in FIG. 3, the channel 111 may have a rectangular cross section, and the mass body 113 may have a circular cross section. When the mass body 113 moves within the channel 111, the damping fluid 114 flows through corners of the rectangular cross section of the channel 111. Therefore, excessive restriction of movement of the mass body 111 by the damping fluid 114 is prevented.

The mass body 113 may be provided in a cylindrical shape extended in the circumferential direction of the channel 111. However, the mass body 113 is not limited to the cylindrical shape, and may alternatively be provided in a polygonal rod shape. Further, the cross section of the mass body 113 may be varied in the circumferential direction of the channel 111.

The confinement unit 120 confines the mass body 113 within the balancer housing 112 so as to fix the mass body 113 to the balancer housing 112. Therefore, when the drum 30 is rotated, the mass body 113 moves relative to the balancer housing 112 but is rotated together with the balancer housing 112.

The mass body 113 may be made of a permanent magnet, and the confinement unit 120 may include a magnetic body so that the mass body 113 is fixed to the balancer housing 112 by magnetic force. On the other hand, the confinement unit 120 may include a permanent magnet, and the mass body 113 may be made of a metal attracted to the magnet.

If the mass body 113 is made of the permanent magnet, the confinement unit 120 includes plates 122 extended in the circumferential direction of the balancer housing 112 and made of a metal attracted to the magnet. The plates 122 are provided in a ring shape. The plural plates 122 are arranged in the circumferential direction of the balancer housing 112.

If the balancer housing 112 is manufactured by injection molding using plastic, the plates 122 may be inserted into the balancer housing 112 during the injection molding process of the balancer housing 112. Alternatively, the plates 122 may be fixed to the outer surface of the balancer housing 112, or be disposed at the outside of the balancer housing 112 through separate fixing structures.

The plates 122 are located at the outside of the channel 11 in the radial direction of the drum 30. If the plates 122 are located at the inside of the channel 111 in the radial direction of the drum 30, there is a possibility of the mass body 113 moving due to centrifugal force applied to the mass body 113 during rotation of the drum 30 even though the mass body 113 is fixed to the balancer housing 112 by magnetic force. However, if the plates 122 are located at the outside of the channel 111, magnetic force and centrifugal force are applied to the mass body 113 in the same direction and thus the mass body 113 is stably fixed to the balancer housing 112.

Instead of preparation of such separate metal members in the balancer housing 112, the balancer housing 112 itself may be made of a metal attracted to the magnet. In this case, the balancer housing 112 itself serves as a confinement unit.

The adjustment unit 130 releases confinement of the mass body 113 during rotation of the drum 30, thereby allowing the mass body 13 to descend within the channel 111 due to gravity. When the mass body 113 passes by the adjustment unit 130, the adjustment unit 130 temporarily releases confinement of the mass body 113. Thereby, the mass body 113 descends due to gravity, and moves within the channel 111.

The adjustment unit 130 includes an electromagnet 131 disposed to generate magnetic force in a direction offsetting attractive force between the mass body 113 and the balancer housing 112.

When the mass body 113 is influenced by the electromagnet 131, the mass body 113 temporarily descends and moves relative to the balancer housing 112, and when the drum 30 is continuously rotated and thus the mass body 113 escapes from the influence of the electromagnet 131, the mass body 113 is again fixed to the balancer housing 112.

Displacement of a moving angle of the mass body 113 when the mass body 113 passes by the electromagnet 131 is varied according to the position of the electromagnet 131, the viscosity of the damping fluid 114, the mass of the mass body 113, the rotating speed of the drum 30, and so on. For example, if the electromagnet 131 is installed, as shown in FIG. 2, and the mass body 113 is designed so as to move by an angle of about 1° when the mass body 113 passes by the electromagnet 131, the mass body 113 moves by an angle of about 1° in the clockwise direction whenever the drum 30 is rotated once.

The electromagnet 131 is disposed above a horizontal line H passing through the center O of rotation of the drum 30 so as to effectively move the mass body 113 due to gravity when the confinement of the mass body 113 is released.

The electromagnet 131 is disposed at the outside of the tub 20, and is disposed in a region R which is in the range of angles 30~60° with respect to the horizontal line H. In order to allow the mass body 113 to effectively descend, the electromagnet 131 may be installed close to the horizontal line H. However, in order to install the electromagnet 13 close to the horizontal line H, a separate space between the tub 20 and the cabinet 10 to install the electromagnet 131 therein needs to be assured. This causes a difficulty in decreasing the size of the washing machine or increasing the washing capacity of the washing machine.

When the electromagnet 131 is arranged in the region R, as shown in FIG. 2, the mass body 113 is effectively moved due to gravity and it is not necessary to increase the width of the washing machine 1 or to decrease the washing capacity of the washing machine 1 to install the electromagnet 131.

As shown in FIGS. 1 and 2, the washing machine 1 includes a load sensor 82, an electromagnet drive unit 84 and a control unit 86.

The load sensor 82 serves to sense magnitude and direction of unbalanced load generated in the drum 30 during rotation of the drum 30, and includes an acceleration sensor to detect acceleration of the tub 20 in the vertical direction. The load sensor 82 is installed within the damper 80.

The electromagnet drive unit 84 drives the electromagnet 131 according to a control signal from the control unit 86. The control unit 86 detects the magnitude and direction of the unbalanced load from a sensing result of the load sensor 82, and controls the electromagnet 131 so that the mass body 131 moves to a position offsetting the unbalanced load.

The lowest peak of an acceleration component detected by the acceleration sensor appears when the unbalanced load is present at an angle of 90 ahead from the highest position of the drum 30 in the rotating direction of the drum 30. Direction (angle position) of the unbalanced load applied to the drum 30 is detected using such a characteristic. Further, since a fluctuation amplitude of the acceleration component corresponds to the magnitude of the unbalanced load present in the drum 30, when the relationship between the fluctuation amplitude and the magnitude of the unbalanced load are found in advance, the magnitude of the unbalanced load may be obtained based on the relationship.

Figure 4:
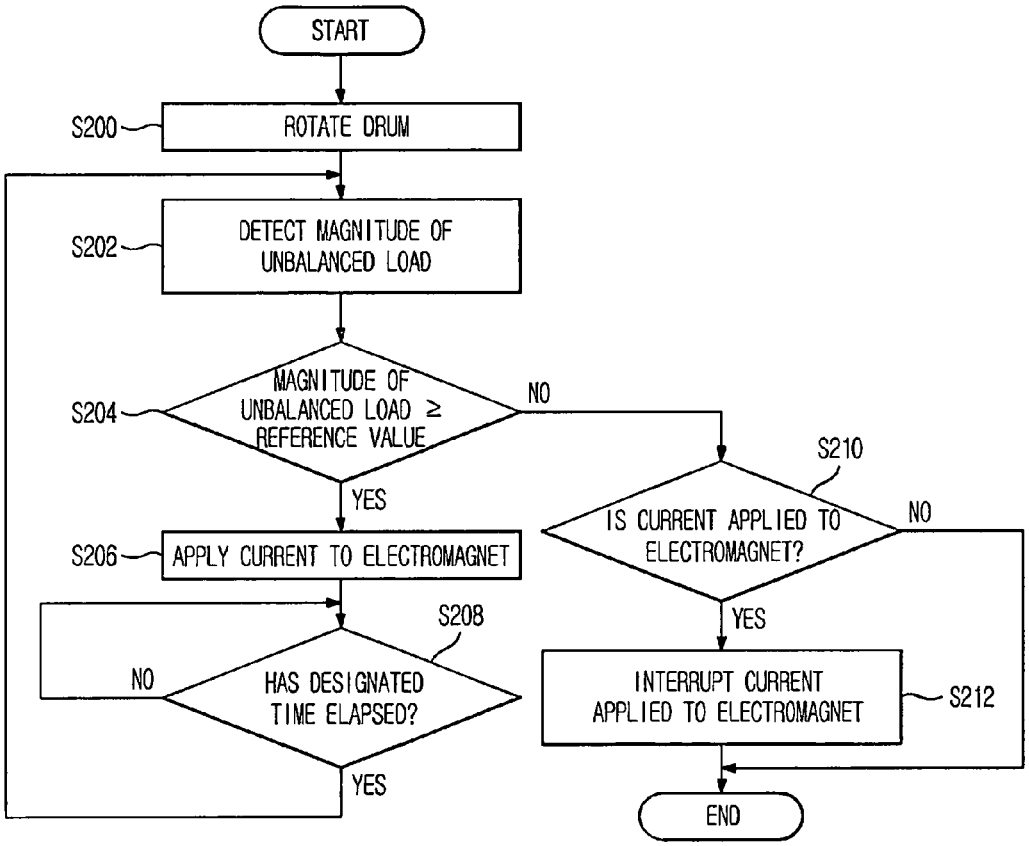
FIG. 4 is a control flow chart of the balancing device of FIG. 2.

FIG. 4 is a control flow chart of the balancing device of FIG. 2.

Before the drum 30 is rotated at a high speed to spin-dry laundry, the control unit 86 rotates the drum 30 at a designated speed (for example, 100 rpm) (operation S200). Here, the drum 30 is rotated under the condition that free movement of the laundry is restricted by centrifugal force and the mass body 113 is fixed to the balancer housing 112 by magnetic force. In FIG. 2, L represents eccentric laundry.

The control unit 86 receives a sensing result of the load sensor 82 during rotation of the drum 30 and thus detects magnitude of unbalanced load applied to the drum 30 (operation S202), and compares the detected magnitude of the unbalanced load with a reference value (operation S204).

As a comparing result of operation S204, upon judging that the detected magnitude of the unbalanced load is greater than or equal to the reference value, the control unit 86 controls the electromagnet drive unit 84 so that current is applied to the electromagnet 131 (operation S206).

Thereafter, the control unit 86 judges whether or not a designated time has elapsed (operation S208). Here, the designated time is a time set such that the mass body 113 passes by the electromagnet 131 at least once after current is applied to the electromagnet 131.

When the mass body 113 passes by the electromagnet 131 in the ON state, confinement of the mass body 113 to the balancer housing 112 is temporarily released by magnetic force applied from the electromagnet 131, and the mass body 113 moves due to gravity. That is, the mass body 133 descends by a designated angle and moves whenever the mass body 133 passes by the electromagnet 131 in the ON state. FIG. 2 illustrates the descended and moved state of the mass body 113 by a virtual line. When the mass body 113 escapes from the influence of the electromagnet 131, the mass body 113 is again fixed to the balancer housing 112.

If the control unit 86 judges that the designated time has elapsed since application of the current to the electromagnet 131, the control unit 86 checks whether or not the unbalanced state is solved by detecting the magnitude of unbalanced load present in the drum 30 and comparing the magnitude with the reference value.

As a checking result, upon judging that the magnitude of the unbalanced load is less than the reference value and thus the mass body 113 is located at a position opposite the eccentric laundry, the control unit 86 judges whether or not current is applied to the electromagnet 131 (operation S210), and interrupts current applied to the electromagnet 131 through the electromagnet drive unit 84, upon judging that current is applied to the electromagnet 131 (operation S212).

If the unbalanced load present in the drum 30 is balanced through active control of movement of the mass body 113, as described above, the unbalanced load is rapidly balanced and thus vibration even in a low-speed rotation section of the drum 30 is effectively reduced.

After the unbalanced load present in the drum 30 is balanced, the control unit 86 rotates the drum 30 at a high speed so as to spin-dry the laundry.

Figure 5:
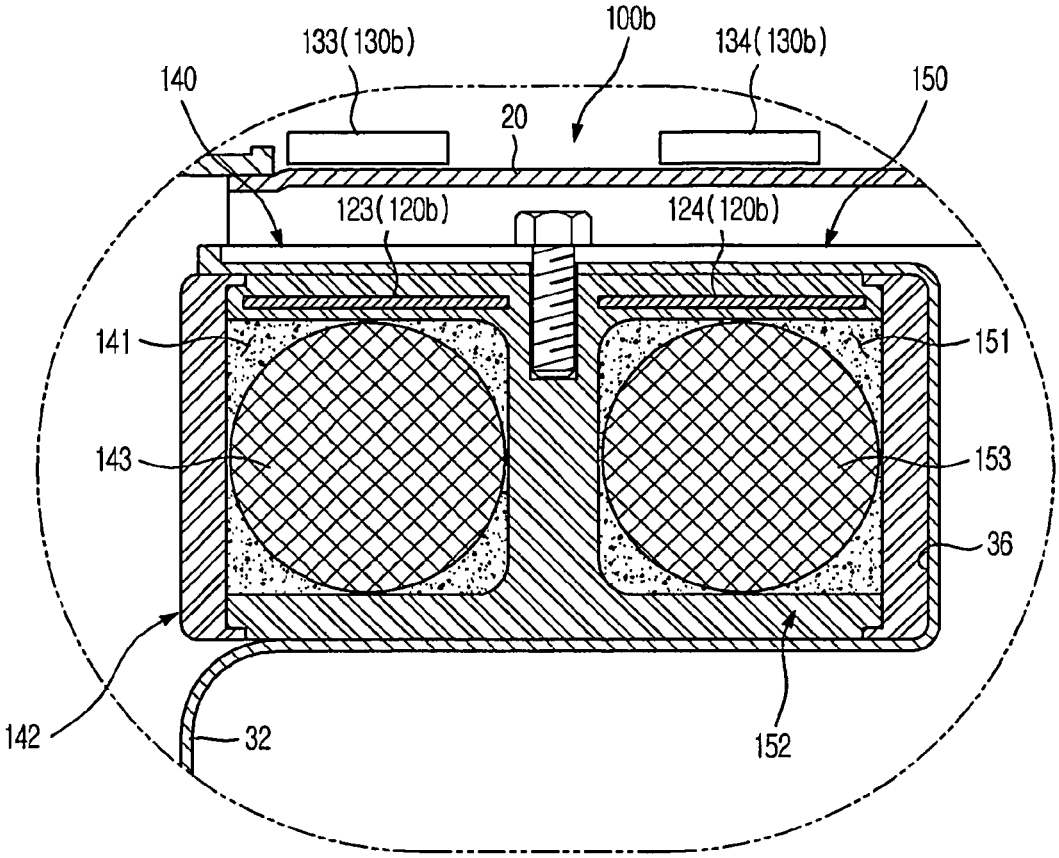
FIG. 5 is a view illustrating a configuration of a balancing device of a washing machine in accordance with another embodiment.
Figure 6A:
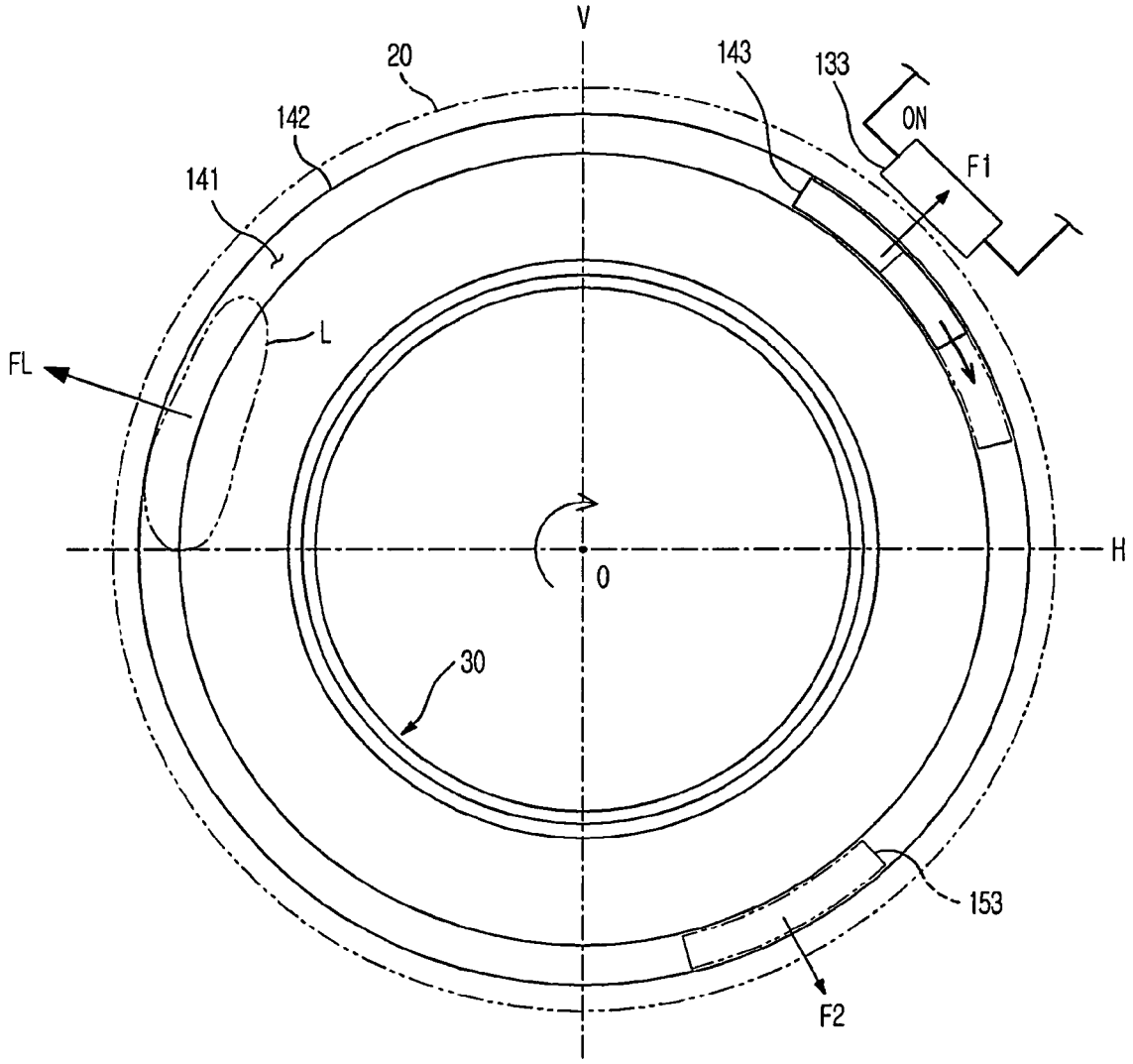
FIG. 6A is a view illustrating a first balancer and a first mass body controlling electromagnet of the balancing device FIG. 5.
Figure 6B:
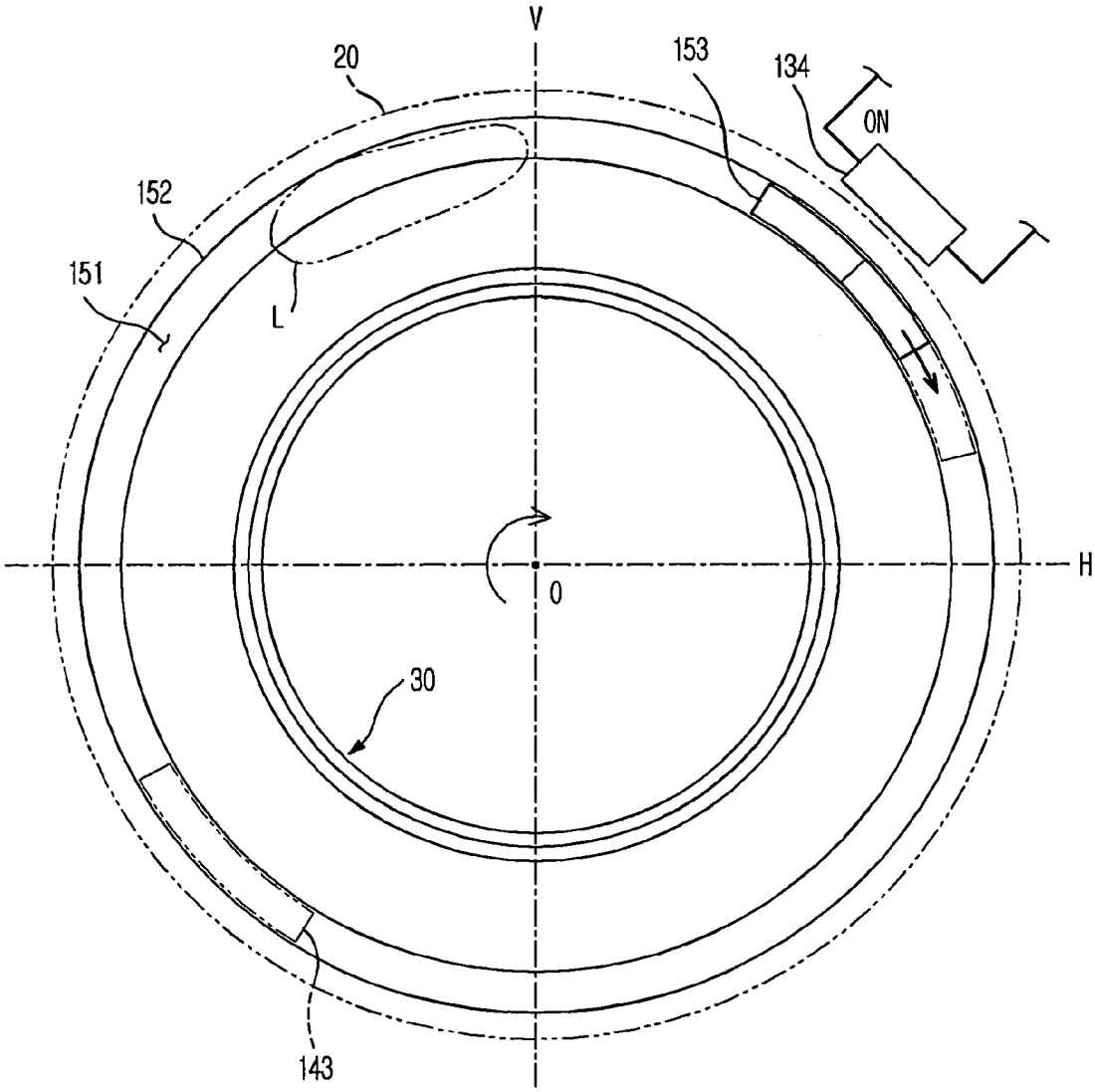
FIG. 6B is a view illustrating a second balancer and a second mass body controlling electromagnet of the balancing device of FIG. 5.

FIG. 5 is a view illustrating a configuration of a balancing device of a washing machine in accordance with another embodiment, FIG. 6A is a view illustrating a first balancer and a first mass body controlling electromagnet of the balancing device FIG. 5, and FIG. 6B is a view illustrating a second balancer and a second mass body controlling electromagnet of the balancing device of FIG. 5. FIG. 6A virtually illustrates a second mass body, and FIG. 6B virtually illustrates a first mass body. Further, FIGS. 6A and 6B exemplarily illustrate different configurations in which the first mass body, the second mass body, and eccentric laundry are disposed.

As shown in FIG. 5 and FIGS. 6A and 6B, a balancing device 100*b* in accordance with this embodiment includes a first balancer 140, a second balancer 150, a confinement unit 120*b* and an adjustment unit 130*b*.

The first balancer 140 includes a first balancer housing 142 having a ring-shaped first channel 141. A first mass body 143 is movably disposed in the first channel 141. The second balancer 150 includes a second balancer housing 152 having a ring-shaped second channel 151. A second mass body 153 is movably disposed in the second channel 151. The inside of the first channel 141 and the inside of the second channel 151 are filled with a damping fluid to prevent the first mass body 143 and the second mass body 153 from rapidly moving.

Although FIG. 5 exemplarily illustrates the first balancer housing 142 and the second balancer housing 152 as being integrated, the first balancer housing 142 and the second balancer housing 152 may be separated from each other.

The first balancer 140 and the second balancer 150 are mounted on the front plate 32 of the drum 30. A ring-shaped recess 36, the front portion of which is opened, is formed on the front plate 32 of the drum 30, and the first balancer 140 and the second balancer 150 running in parallel are received in the recess 36. Alternatively, the first balancer 140 and the second balancer 150 may be mounted on the rear plate 33 of the drum 30 in the same manner.

The first mass body 143 and the second mass body 153 are respectively made of a permanent magnet, and the confinement unit 120*b* includes ring-shaped plates 123 and 124 respectively provided on the first balancer housing 142 and the second balancer housing 152. The first mass body 143 is attached to the first balancer housing 142 by magnetic force applied between the first mass body 143 and the plate 123, and the second mass body 153 is attached to the second balancer housing 152 by magnetic force applied between the second mass body 153 and the plate 124.

The adjustment unit 130*b* releases confinement of the mass bodies 143 and 153 during rotation of the drum 30, thereby allowing the mass bodies 143 and 153 to descend within the respective channels 141 and 151 due to gravity.

The adjustment unit 130*b* includes a first mass body controlling electromagnet 133 disposed to apply magnetic force to the first mass body 143 and a second mass body controlling electromagnet 134 disposed to apply magnetic force to the second mass body 153.

The electromagnets 133 and 134 are disposed at the outside of the tub 20. The electromagnets 133 and 134 are disposed above a horizontal line H passing through the center O of rotation of the drum 30, and are disposed at the same side of a vertical line V passing through the center O of rotation of the drum 30.

Figure 7:
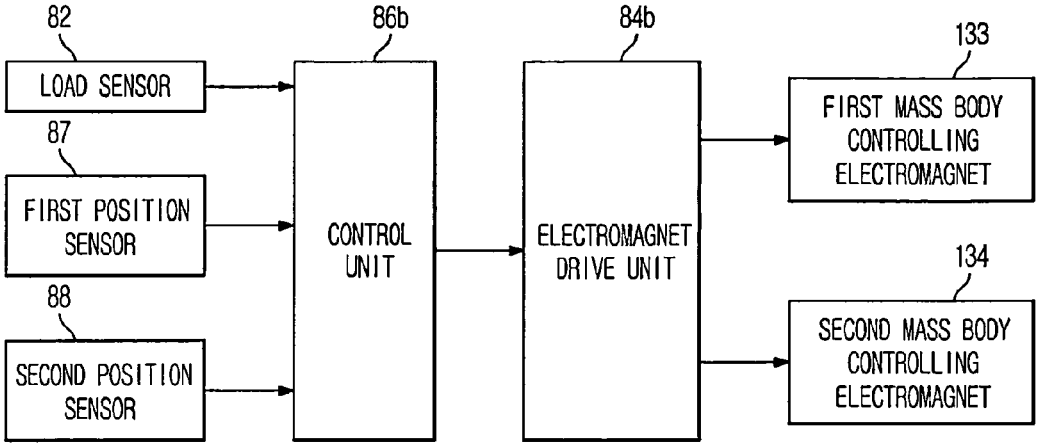
FIG. 7 is a block diagram illustrating a configuration to control the balancing device of FIG. 5.

FIG. 7 is a block diagram illustrating a configuration to control the balancing device of FIG. 5. As shown in FIG. 7, the washing machine 1 includes a load sensor 82, a first position sensor 87, a second position sensor 88, an electromagnet drive unit 84*b* and a control unit 86*b*.

The load sensor 82 serves to sense magnitude and direction of unbalanced load generated in the drum 30 during rotation of the drum 30, and includes an acceleration sensor to detect acceleration of the tub 20 in the vertical direction.

The first position sensor 87 and the second position sensor 88 are respectively installed around the first balancer housing 142 and the second balancer housing 143 so as to detect rotated positions of the first mass body 143 and the second mass body 153 during rotation of the drum 30. The first position sensor 87 and the second position sensor 88 may respectively include switches operated by magnetic forces of the first mass body 143 and the second mass body 153, optical sensors, or ultrasonic sensors.

The control unit 86*b* detects the magnitude and direction of the unbalanced load from a sensing result of the load sensor 82, and therethrough detects positions of the first mass body 143 and the second mass body 153 to effectively offset the unbalanced load. If plural mass bodies, i.e., two mass bodies are used, the sum total of centrifugal forces applied to the two mass bodies is located opposite centrifugal force applied to eccentric laundry, thereby offsetting the unbalanced load. That is, the two mass bodies are located so as to be symmetrical with respect to an axis to which the unbalanced load is applied, and an angle of each mass body with respect to the axis is determined by the magnitude of the unbalanced load.

The control unit 86*b* determines which mass body needs to be moved to rapidly offset the unbalanced load, and applies current to at least one of the first mass body controlling electromagnet 133 and the second mass body controlling electromagnet 134 through the electromagnet drive unit 84*b*, thereby moving at least one of the first mass body 143 and the second mass body 153 to a desired position.

As one example, if the first mass body 143, the second mass body 153, and the eccentric laundry L are disposed, as shown in FIG. 6A, the control unit 86*b* analyzes magnitudes and directions of centrifugal force F1 applied to the first mass body 143, centrifugal force F2 applied to the second mass body 153, and centrifugal force FL applied to the eccentric laundry L. The control unit 86*b* determines that the first mass body 143 needs to be moved so as to balance the drum 30 based on an analyzing result, and applies current to the first mass body controlling electromagnet 133.

As another example, if the first mass body 143, the second mass body 153, and the eccentric laundry L are disposed, as shown in FIG. 6B, the control unit 86*b* determines that the second first mass body 143 needs to be moved, and applies current to the second mass body controlling electromagnet 134.

FIG. 6A virtually illustrates the second mass body 153 and FIG. 6B virtually illustrates the first mass body 143. Here, for convenience of understanding, movement of the first mass body 143 and the second mass body 153 may be exaggerated.

Figure 8:
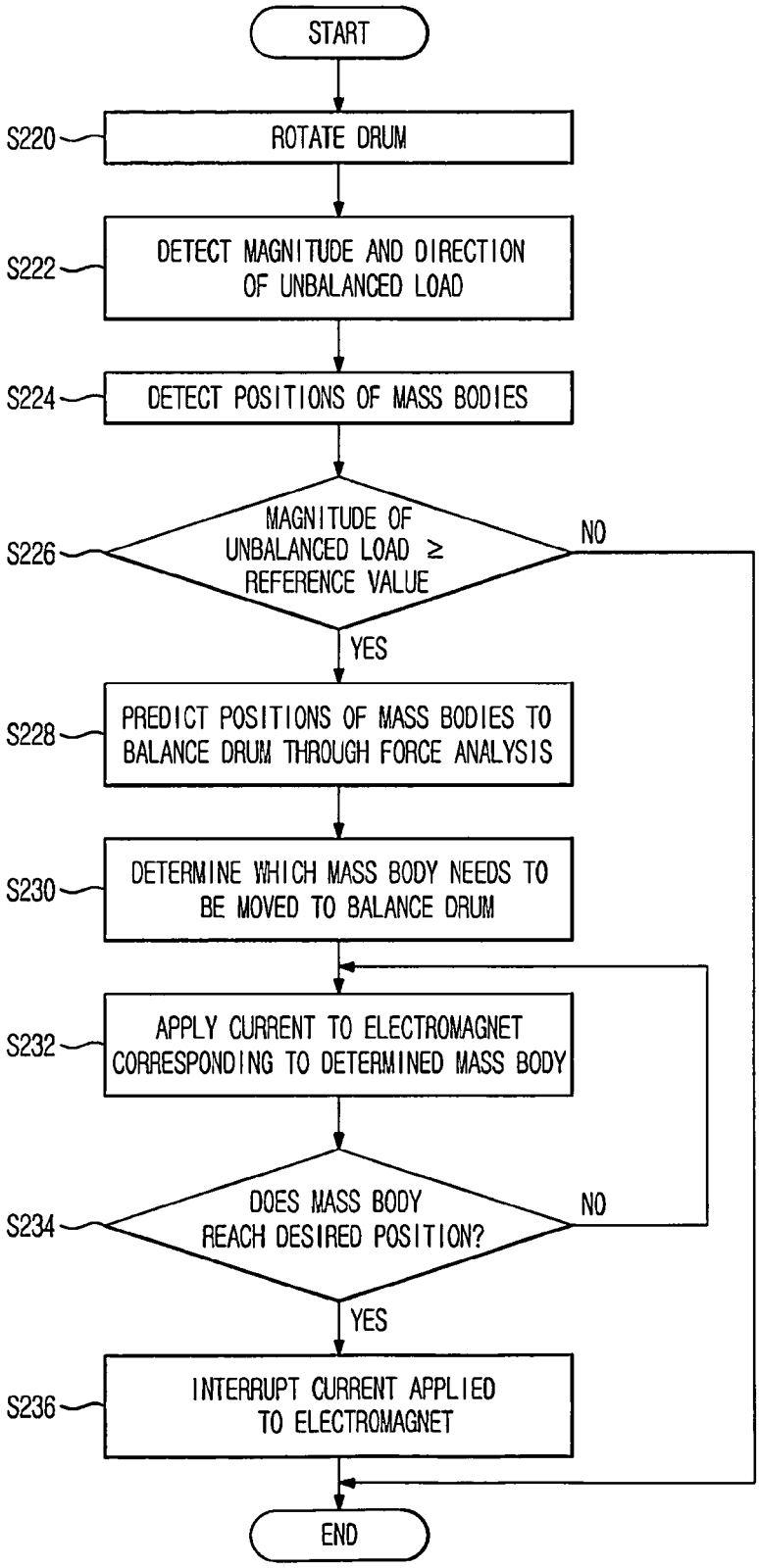
FIG. 8 is a control flow chart of the balancing device shown in FIGS. 5 to 7.

FIG. 8 is a control flow chart of the balancing device shown in FIGS. 5 to 7.

Before the drum 30 is rotated at high speed to spin-dry laundry, the control unit 86*b* rotates the drum 30 at a designated speed (for example, 100 rpm) (operation S220). Here, the drum 30 is rotated under the condition that free movement of the laundry is restricted by centrifugal force and the first mass body 143 and the second mass body 153 are fixed to the first balancer housing 142 and second balancer housing 152.

The control unit 86*b* receives a sensing result of the load sensor 82 during rotation of the drum 30 and thus detects magnitude and direction of unbalanced load applied to the drum 30 (operation S222). Further, the control unit 86*b* receives sensing results of the first position sensor 87 and the second position sensor 88 and thus detects positions of the first mass body 143 and the second mass body 153 (operation S224).

Thereafter, the control unit 86*b* compares the detected magnitude of the unbalanced load with a reference value (operation S226). As a comparing result, upon judging that the detected magnitude of the unbalanced load is greater than or equal to the reference value, the control unit 86*b* predicts positions of the mass bodies 143 and 153 to offset the unbalanced load through force analysis (operation S228).

The control unit 86*b* determines which mass body needs to be moved to balance the drum 30 based on a result of operation 228 (operation 230), and controls the electromagnet drive unit 84*b* so that current is applied to the electromagnet corresponding to the determined mass body so as to move the mass body (operation S232).

Thereafter, the control unit 86*b* judges whether or not the moving mass body reaches the desired position (operation 234). Since an angle by which the mass body moves whenever the mass body passes by the electromagnet is determined when the balancer device 100*b* is designed, the control unit 86*b* finds out the number of times of rotation of the drum 30 until the mass body reaches the desired position through calculation. For example, if the balancing device 100*b* is designed such that the mass body moves by an angle of 1° whenever the mass body passes by the electromagnet, when the first mass body 143 needs to move by an angle of 30° so as to balance the drum 30, the first mass body 143 reaches the desired position after the drum 30 is rotated 30 times.

Upon judging that the moving mass body reaches the desired position, the control unit 86*b* controls the electromagnet drive unit 84*b* so that the current applied to the electromagnet is interrupted (operation S236).

The control unit 86*b* completes control to balance the drum 30, and increases the rotation speed of the drum 30 to spin-dry the laundry.

The balancing device in accordance with the embodiment of FIGS. 5 to 8 employs a plurality of mass bodies, thereby more effectively balancing the drum as compared with the balancing device employing one mass body. That is, in an initial spin-drying stage before balancing is started and if laundry is uniformly distributed in the drum and thus unbalanced load due to the laundry is not great, the mass bodies are located at opposite positions, thereby preventing the mass bodies to balance the drum from causing unbalance.

Figure 9A:
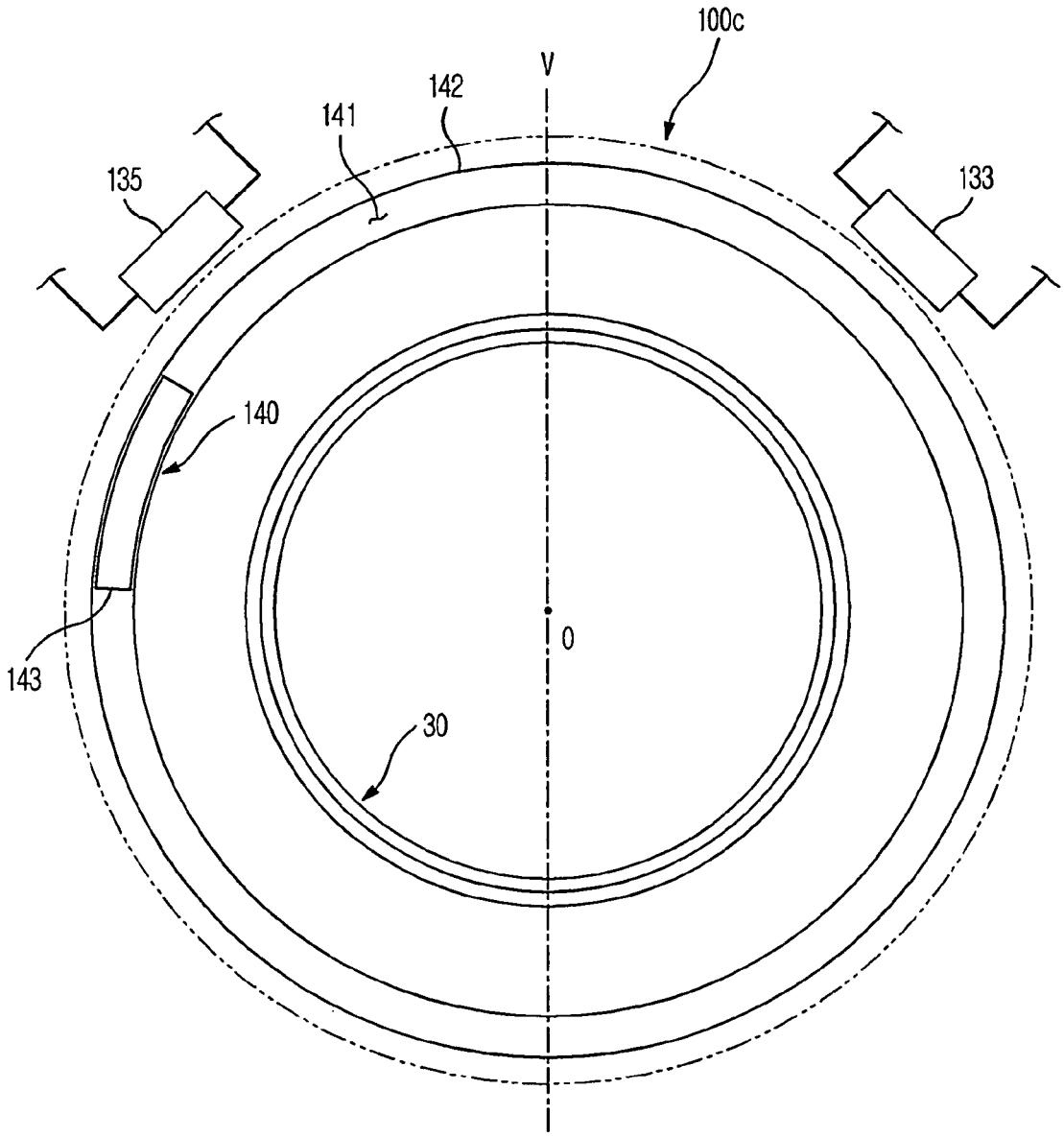
FIGS. 9A and 9B are views illustrating a configuration of a balancing device of a washing machine in accordance with a further embodiment.
Figure 9B:
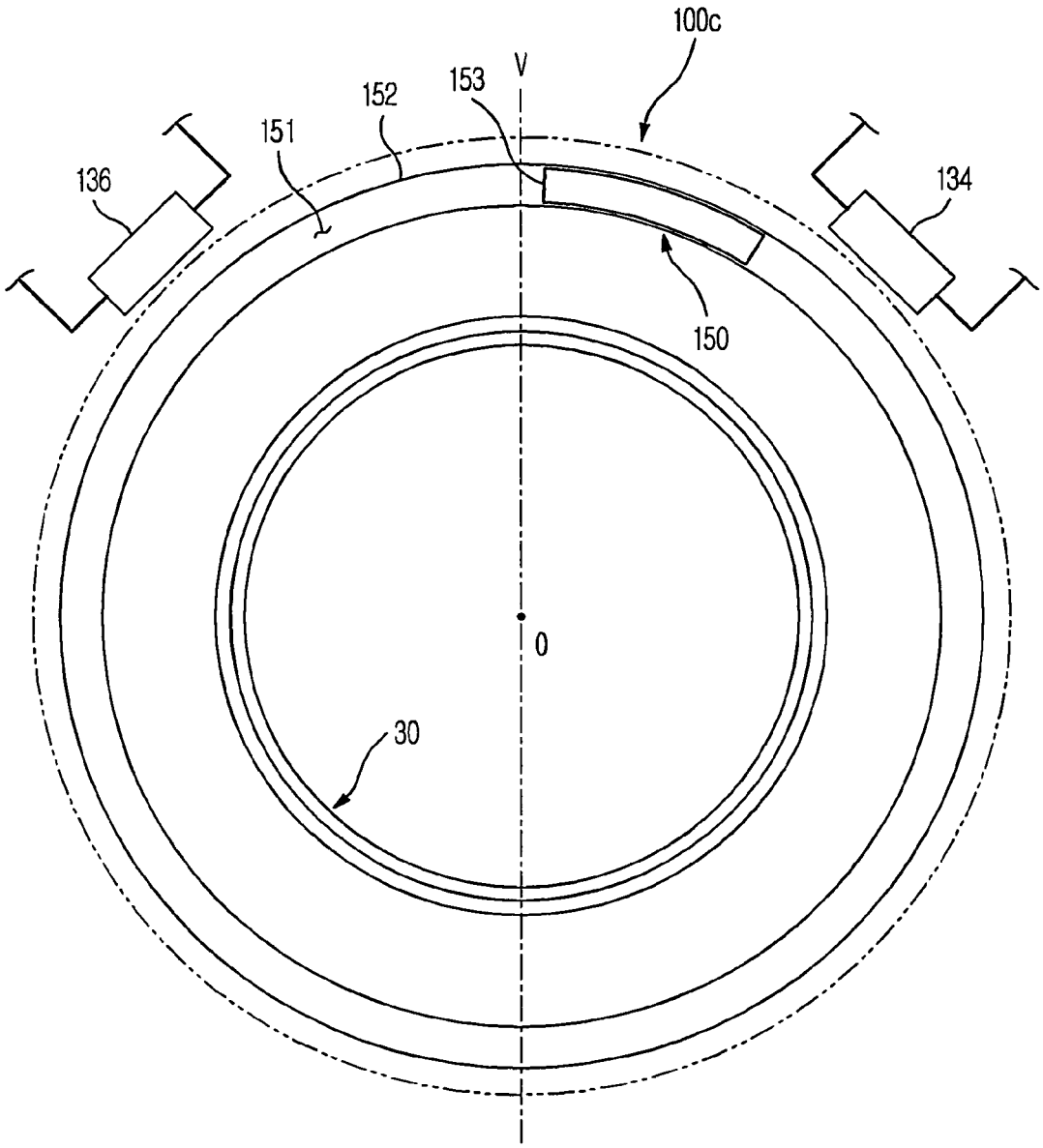

FIGS. 9A and 9B are views illustrating a configuration of a balancing device of a washing machine in accordance with a further embodiment of the present invention. FIG. 9A illustrates a first balancer and a pair of first mass body controlling electromagnets, and FIG. 9B illustrates a second balancer and a pair of second mass body controlling electromagnets.

A balancing device 100*c* in accordance with this embodiment, as shown in FIGS. 9A and 9B, has a similar configuration to the balancing device 100*b* in accordance with the former embodiment, as shown in FIG. 5, except that, in the balancing device 100*c*, a plurality of electromagnets corresponding to each of mass bodies is prepared.

As shown in FIGS. 9A and 9B, the balancing device 100*c* includes a first balancer 140, a second balancer 150, a pair of first mass body controlling electromagnets 133 and 135, a pair of second mass body controlling electromagnets 134 and 136 and a control unit (not shown).

The first balancer 140 includes a first balancer housing 142 having a ring-shaped first channel 141. A first mass body 143 is movably disposed in the first channel 141. The second balancer 150 includes a second balancer housing 152 having a ring-shaped second channel 151. A second mass body 153 is movably disposed in the second channel 151. The first balancer 140 and the second balancer 150 are mounted on the drum 30 in the same structure as that of FIG. 5.

The first mass body 143 and the second mass body 153 are respectively made of a permanent magnet, and are attached to the first balancer housing 142 and the second balancer housing 152 by magnetic force.

The first mass body controlling electromagnets 133 and 135 are arranged in the circumferential direction of the first balancer housing 142 so as to apply magnetic force to the first mass body 133. The first mass body controlling electromagnets 133 and 135 are disposed at different sides of a vertical line V passing through the center O of rotation of the drum 30. The second mass body controlling electromagnets 134 and 136 are arranged in the circumferential direction of the second balancer housing 152 so as to apply magnetic force to the second mass body 153, and are disposed at different sides of the vertical line V.

When current is applied to the electromagnet 133 or 134 disposed at the right side of FIG. 9A or 9B, the first mass body 143 or the second mass body 153 moves in the clockwise direction due to gravity while passing by the electromagnet 133 or 134. On the other hand, when current is applied to the electromagnet 135 or 136 disposed at the left side of FIG. 9A or 9B, the first mass body 143 or the second mass body 153 moves in the counterclockwise direction due to gravity while passing by the electromagnet 135 or 136.

When the washing machine performs an operation to balance the unloaded load present in the drum 30, the control unit (not shown) selects one of the pair of first mass body controlling magnets 133 and 135 and selects one of the pair of second mass body controlling magnets 134 and 136, and applies current to the selected electromagnets, thereby moving the first mass body 143 and the second mass body 153.

In accordance with this embodiment, the control unit (not shown) may move the first mass body 143 and the second mass body 153 in different directions, thereby more rapidly stabilizing rotation of the drum 30.

As is apparent from the above description, a washing machine and a control method thereof in accordance with one embodiment of the present invention actively control movement of a mass body installed in a balancer, thereby rapidly offsetting unbalanced load present in a drum.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a cabinet;

a tub disposed within the cabinet to receive water therein;

a drum disposed within the tub to receive laundry therein and rotated by rotational force transmitted from a drive source;

at least one balancer housing mounted on the drum and provided with a ring-shaped channel formed therein;

at least one mass body movably disposed in the channel of the at least one balancer housing, respectively, the at least one mass unit including a permanent magnet or a magnetic body;

a confinement unit including a permanent magnet or a magnetic body, the confinement unit being positioned on or in the at least one balancer housing and configured to confine the at least one mass body in place in the at least one balancer housing through magnetic attraction between the at least one mass body and the confinement unit;

an adjustment unit to release confinement of the at least one mass body to the confinement unit by counteracting the magnetic force between the at least one mass body and the confinement unit, the adjustment unit including at least one electromagnet disposed proximate to the at least one balancer housing and configured to generate magnetic force in a direction offsetting the magnetic force between the at least one mass body and the confinement unit; and a control unit to control the adjustment unit so that unbalanced load present in the drum is offset by the at least one mass body.

2. The washing machine according to claim 1, wherein the at least one electromagnet is disposed above a horizontal line passing through the center of rotation of the drum.

3. The washing machine according to claim 2, wherein the at least one electromagnet is disposed in a region which is in the range of angles of 30~60° with respect to the horizontal line.

4. The washing machine according to claim 1, wherein the at least one electromagnet includes a plurality of electromagnets arranged in the circumferential direction of the drum, wherein two of the plurality of electromagnets are disposed at opposite sides of a vertical line passing through the center of rotation of the drum.

5. The washing machine according to claim 1, wherein:

the at least one mass body includes a first mass body and a second mass body disposed in different channels; and the at least one electromagnet includes at least one first mass body controlling electromagnet disposed to apply magnetic force to the first mass body and at least one second mass body controlling electromagnet disposed to apply magnetic force to the second mass body.

6. The washing machine according to claim 1, further comprising:

a load sensor to sense magnitude and direction of the unbalanced load applied to the drum during rotation of the drum; and a position sensor to sense a rotated position of the at least one mass body, wherein the control unit determines a position of the at least one mass body to offset the unbalanced load based on sensing results of the load sensor and the position sensor, and controls the at least one electromagnet so that the at least one mass body is moved to the determined position.

7. The washing machine according to claim 1, wherein:

the drum includes a cylindrical part, and a front plate and a rear plate respectively disposed at the front and rear portions of the cylindrical part;

the at least one balancer housing includes a first balancer housing and a second balancer housing disposed so as to be stacked in the direction of a rotation axis of the drum; and the first balancer housing and the second balancer housing are mounted on at least one of the front plate and the rear plate.

8. The washing machine according to claim 1, wherein the at least one mass body is formed in a rod shape extended in the circumferential direction of the ring-shaped channel.

9. The washing machine according to claim 1, wherein the inside of the channel of the at least one balancer housing is filled with a damping fluid.

10. A washing machine, comprising:

a cabinet;

a tub disposed within the cabinet to receive water therein;

a drum disposed within the tub to receive laundry therein and rotated by rotational force transmitted from a drive source;

at least one balancer housing mounted on the drum and provided with a ring-shaped channel formed therein;

at least one mass body movably disposed in the channel of the at least one balancer housing, respectively, the at least one mass body including a permanent magnet;

a confinement unit comprising a plurality of magnetic plates formed in a ring-shaped provided on or in the balancer housing so as to be located at the outside of the channel in the radial direction of the drum and configured to confine the at least one mass body in place in the at least one balancer housing through magnetic attraction between the at least one mass body and the confinement unit;

an adjustment unit to release confinement of the at least one mass body to the confinement unit by counteracting the magnetic force between the at least one mass body and the confinement unit; and a control unit to control the adjustment unit so that unbalanced load present in the drum is offset by the at least one mass body.

11. The washing machine according to claim 10, wherein:

the at least one balancer housing is an injection molded product made of plastic; and the plurality of plates formed in a ring-shape are inserted into the at least one balancer housing.

12. A washing machine, comprising:

a cabinet;

a tub disposed within the cabinet to receive water therein;

a drum disposed within the tub to receive laundry therein and rotated by rotational force transmitted from a drive source;

at least one balancer housing mounted on the drum and provided with a ring-shaped channel formed therein, the at least one balancing housing being made of a magnetic metal;

at least one mass body movably disposed in the channel of the at least one balancer housing, respectively, the at least one mass unit including a permanent magnet;

an adjustment unit to counteract the magnetic force between the permanent magnet of the at least one mass body and the magnetic metal of the at least one balancer housing, the adjustment unit including at least one electromagnet disposed outside of the tub and proximate to the at least one balancer housing and configured to generate magnetic force in a direction offsetting the magnetic force between the at least one mass body and the at least one balancer housing; and a control unit to control the adjustment unit so that unbalanced load present in the drum is offset by the at least one mass body.

* * * * *